United States Patent [19]

McGready

[11] Patent Number: 4,715,120

[45] Date of Patent: Dec. 29, 1987

[54] RAZORS, AND SHAVING UNITS FOR RAZORS

[75] Inventor: Angus J. McGready, Reading, England

[73] Assignee: Wilkinson Sword Limited, London, England

[21] Appl. No.: 895,546

[22] Filed: Aug. 11, 1986

Related U.S. Application Data

[63] Continuation of Ser. No. 374,669, May 4, 1982, abandoned.

[30] Foreign Application Priority Data

May 19, 1981 [GB] United Kingdom ..... 8115320

[51] Int. Cl.[4] ..... B26B 21/14

[52] U.S. Cl. ..... 30/57; 30/79; 30/63

[58] Field of Search ..... 30/47, 57, 64, 79, 63

[56] References Cited

U.S. PATENT DOCUMENTS

| | | | |
|---|---|---|---|
| 2,294,284 | 8/1942 | Chu . | |
| 3,793,725 | 2/1974 | Dawidowicz . | |
| 3,816,914 | 6/1974 | Wordtmann | 30/64 |
| 3,871,077 | 4/1975 | Nissen . | |
| 3,892,036 | 7/1975 | Perry | 30/62 |
| 3,964,159 | 6/1976 | Ferraro . | |
| 4,227,302 | 10/1980 | Torrance | 30/47 |
| 4,300,285 | 11/1981 | Endo . | |

FOREIGN PATENT DOCUMENTS

| | | |
|---|---|---|
| 70370 | 6/1892 | Fed. Rep. of Germany . |
| 54378 | 3/1977 | Japan . |
| 56-31785 | 3/1981 | Japan . |
| 146052 | 7/1920 | United Kingdom . |

*Primary Examiner*—E. R. Kazenske
*Assistant Examiner*—Willmon Fridie, Jr.
*Attorney, Agent, or Firm*—Finnegan, Henderson, Farabow, Garrett & Dunner

[57] ABSTRACT

A razor blade assembly which comprises at least one blade secured to a blade platform, a top cap covering the blade, a handle and a guardbar, the blade and blade platform being pivotally movable relative to the top cap between a shaving position in which the blade edge is exposed, and a position in which the blade edge is withdrawn from the shaving position to protect the user.

8 Claims, 12 Drawing Figures

RAZORS, AND SHAVING UNITS FOR RAZORS

This is a continuation of application Ser. No. 374,669, filed May 4, 1982, now abandoned.

BACKGROUND OF THE INVENTION

This invention relates to razor blade assembly, in the form of a complete razor or a shaving unit for a razor. By 'shaving unit' is meant a blade assembly which can be mounted on or formed integrally with a handle or a razor frame to provide a complete razor. In particular the invention relates to a disposable razor, that is to say one that is intended to be disposed of by the user when he considers that the razor is no longer giving an adequate shave. More particularly, the invention relates to the provision, in such a blade assembly, of means movable to expose the cutting edge of the blade for shaving or to render it safe so that it cannot harm anyone handling the blade assembly.

BRIEF SUMMARY OF THE INVENTION

According to the present invention there is provided a razor blade assembly whose components comprise a razor blade having a cutting edge, a top cap and a guard bar spaced from the adjacent edge of the top cap to form an opening therebetween, and means supporting at least one of the components of the blade assembly for pivotal movement relative to at least one other of said components to cause movement of the blade relative to said opening between a first position in which the cutting edge of said blade is exposed for shaving and a second position in which the cutting edge of the blade is not exposed for shaving.

BRIEF DESCRIPTION OF THE DRAWINGS

The invention will be better understood from a consideration of the following description of three constructions of razor in accordance with the present invention which will be described, by way of example only, with reference to the accompanying drawings in which.

DETAILED DESCRIPTION

Figure 1:
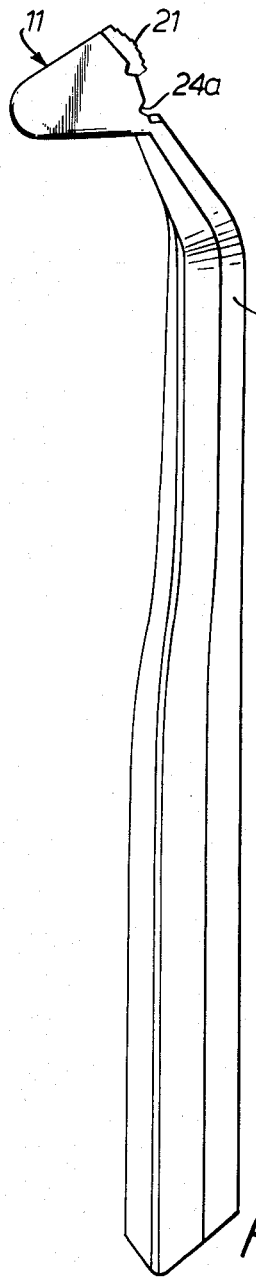
FIG. 1 is a side elevation, part in section, of one form of razor in accordance with the invention.
Figure 2:
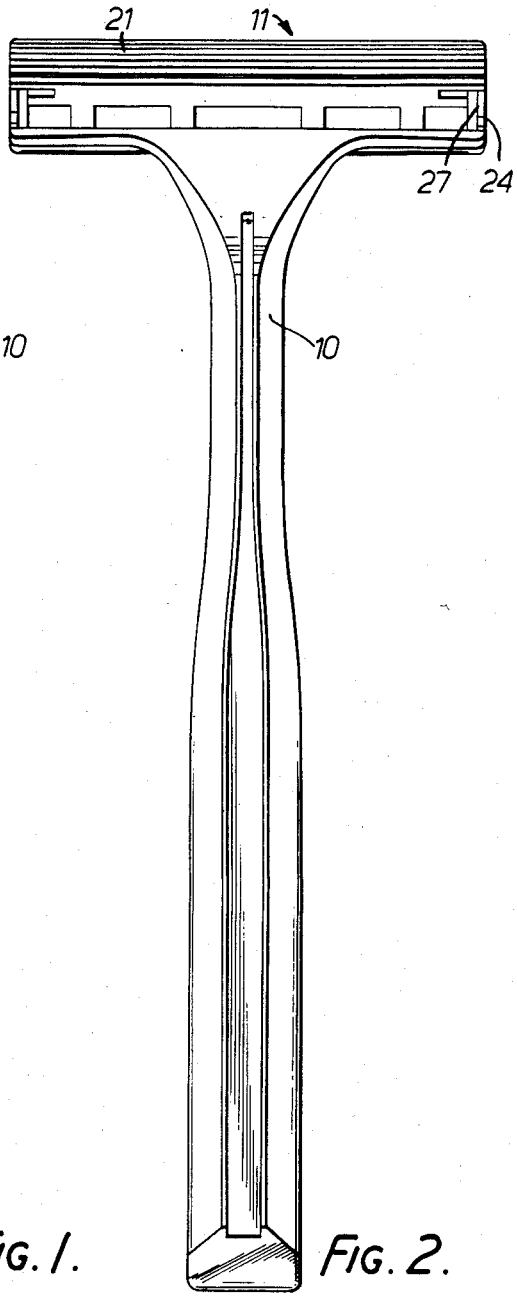
FIG. 2 is a rear elevation of the razor of FIG. 1.

The razor illustrated in the accompanying drawings is formed by two main components, the first being a handle 10 at one end of which a razor head 11 is formed integrally. The handle and head can be moulded in one piece in plastics material.

The second component of the razor is a blade platform 12 on which a blade 13 (or if desired a parallel-spaced pair of blades) is mounted between blade locating posts 14 and secured to the platform by rivets 15, the posts 14 and rivets 15 being formed integrally with the platform.

On the side of the platform 12 which is adjacent the cutting edge 13*a* of the blade 13, a guardbar 16 is formed integrally with the platform, the guardbar being connected to the platform by webs 17. The webs 17 are spaced apart along the guardbar to form apertures between the guardbar and the platform through which water can be directed to wash the blade edge.

Pivot pins 18 project from the opposite ends of the platform along a line parallel to and below the cutting edge of the blade for engagement in bearing apertures or recesses 19 in the head 11 to be described below.

The side of the platform 12, which is parallel to but remote from the guardbar, is formed with an operating bar 20. The operating bar carries ribs 21, on its rearward surface for engagement by the finger of a user, and a pair of detents 22 located at opposite ends of the bar 21 for a purpose to be described below.

The razor head 11 is formed as a V-section trough 23 which is defined between two triangular shaped end walls 24, an upper wall 25 forming a top cap of the razor, a base wall 26 which is integral with the upper end of the razor handle, and a rear wall 27 which is integral with the end walls 24 and upper wall 25 but spaced from the base wall 26. The upper wall 25 and base wall 26 are spaced apart, the spacing at their forward edges being less than at their rearward edges to provide the V section trough therebetween. The end walls 24 are arranged to fit over the ends of the integral blade platform and guardbar, the forward ends of the walls 24 containing the bearing apertures 19 in which the pivot pins 18 are received.

The rearward edge 24*a* of each of the end walls 24 of the razor head is formed with a pair of spaced indentations 24*b*, which are engageable resiliently by the detents, such as 22, of the operating bar 20 when the razor platform is in its uppermost tilted position or in its lowermost tilted position respectively to lock the platform in these positions.

Figure 3:
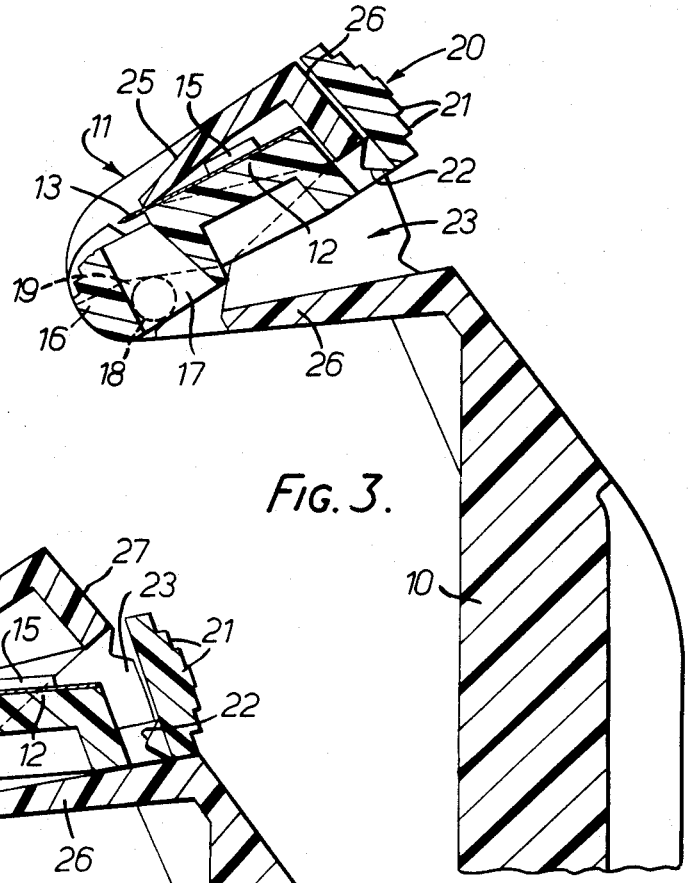
FIG. 3 is a section through the razor head showing the blade in a "shaving" position.
Figure 4:
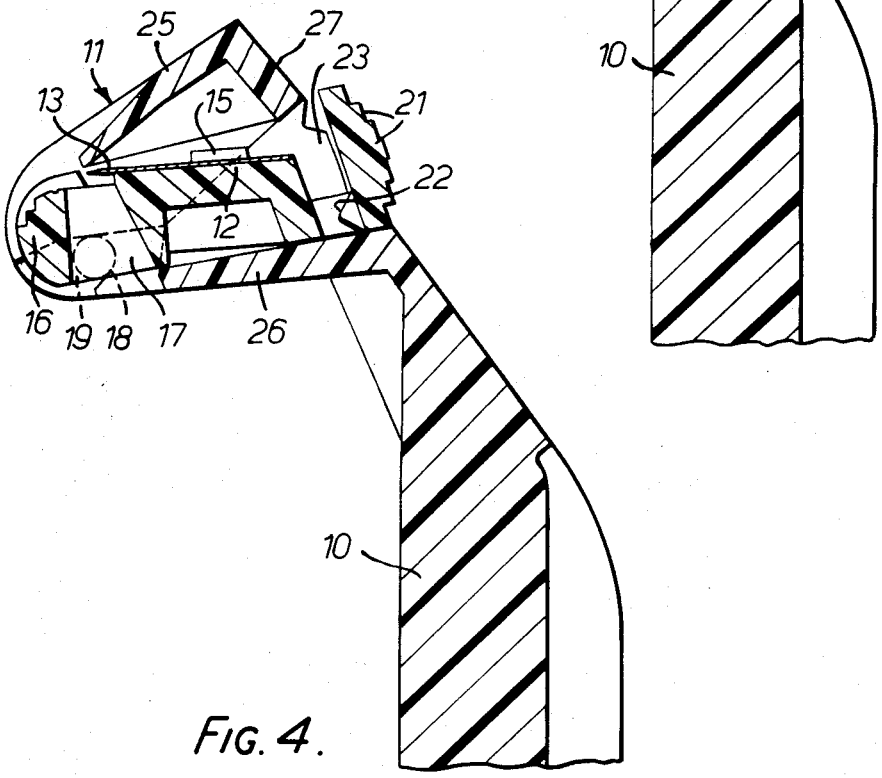
FIG. 4 is a section through the razor head showing the blade in a "safe" position.
Figure 5:
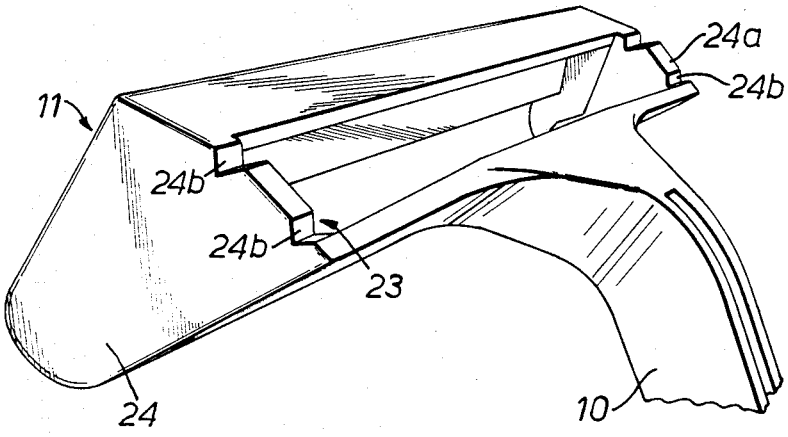
FIG. 5 is an exploded perspective view of the head of the razor.
Figure 5:
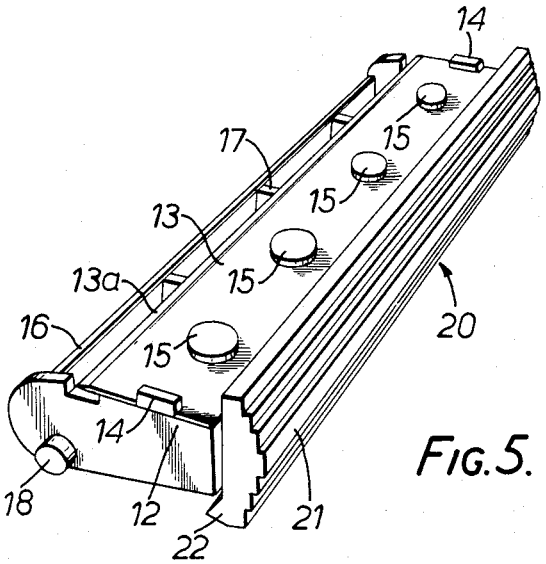

The uppermost tilted position, which is shown in FIG. 3, is the "shaving", or blade-exposed, position of the razor blade. In this position, the blade is at the correct shaving angle and location relative to those surfaces of the guardbar 16 and of the top cap 25 which contact the skin of the shaver. The lowermost tilted position, which is shown in FIG. 4, is the travel, or 'safe' position of the razor blade in which the blade edge is withdrawn from the shaving position and lies a sufficient distance below the opening defined between the top cap 25 and guardbar 16 to be in a position in which it cannot injure anyone handling the razor. The resiliency of the bearings and of the detents allows the detents to hold the blade platform securely in the positions of FIGS. 3 or 4 yet permits the blade platform to be moved between these positions by finger pressure on the bar 20.

The V section trough 23 has the manufacturing advantage that assembly of the razor merely requires that the blade platform with blade or blades secured thereto is inserted into the trough and with the bearing pins resiliently urging the end walls 24 apart until these pins engage in the bearing apertures, at which time the detents 22 engage one set of the indentations 24b. Guide channels of progressively decreasing depth may be provided on the inner faces of the end walls to guide the pivot pins into the bearing apertures.

Figure 6:
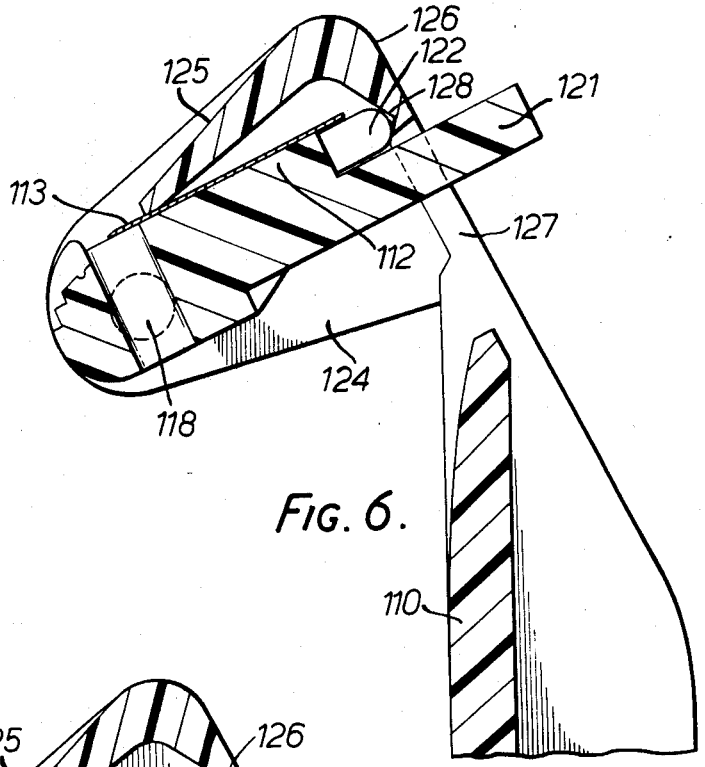
FIGS. 6 and 7 are sections through the razor head of a modification of the embodiment of FIGS. 1 to 5 showing the "shaving" and "safe" positions of the razor blade respectively.
Figure 7:
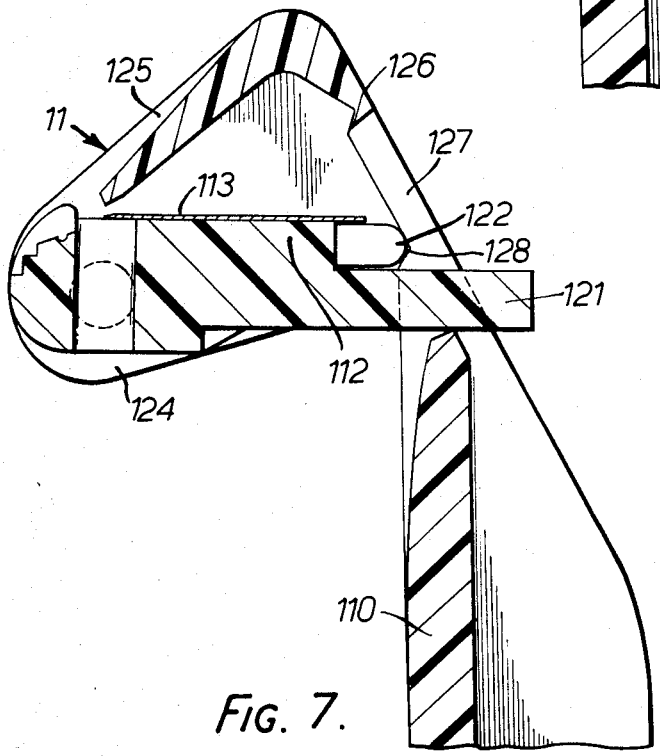

In a modification of the above-described embodiment, and as illustrated in FIGS. 6 and 7 the razor head is formed by a pair of end walls 124, a top cap 125 and a rear wall 126 which is integral with the top cap 125 along its rearward edge and with the end walls 124 along their rearward edges, the rear wall also being integral with the upper end of the razor handle 110.

The razor has a blade platform 112 and blade 113 constructed and movable in substantially the same way as the blade and platform of the first-described embodiment except that the rear wall 126 is formed with a slot 127 extending longitudinally of the handle in which a peg 121 on the platform can engage and slide. The peg 121 projects through the slot 127 to enable the peg to be engaged by a finger or thumb of the user. By pushing the peg along the slot, the platform 112 together with the blade 113 pivots about the axis of pivot pins 118.

The blade platform is formed with a detent 122 for engagement in the "shaving" position of the blade with a recess 128 on the rear wall 126, so that in the shaving position, the blade is securely located and held, although the razor head is not stressed.

In a modification (not illustrated) of the first and second embodiments of the invention, the pivot pins 118 are formed on the end walls 124 and the bearing apertures are formed in the blade platform.

In another modification (not illustrated) of the first and second embodiments of the invention, the guardbar is formed integrally with the end walls of the razor head, so that only the blade and blade platform are pivotally movable.

In the third embodiment of the invention illustrated in FIGS. 8–12 the razor contains a double-edged blade 313 and comprises a handle 310 which is pivoted in a blade platform 312 on an axis parallel to the cutting edges of the double-edged blade 313 which is mounted on the platform 312. The blade is preferably secured to the platform by rivets (not shown). As an alternative to a double-edged blade, two single oppositely-directed blades could be used. As a further alternative, twin blades could be employed. Guard bars 316 are secured to opposite sides of the platform 312.

In this embodiment, a top cap 311 is slidably mounted on the platform for movement in sliding engagement with the blade along a direction perpendicular to the blade cutting edges. For this purpose the top cap is formed integrally with side walls 314 and under-flanges 315 which extend from the bottom of the side walls and engage under the platform 312.

At a central position, the underside of the top cap is formed with rack teeth 319 which engage with pinion teeth 317 formed on the adjacent end of the pivotally mounted handle. The arrangement is such that as the handle is moved pivotally relative to the platform, the top cap is caused to slide along the above-mentioned direction perpendicular to the blade edges.

Figure 9:
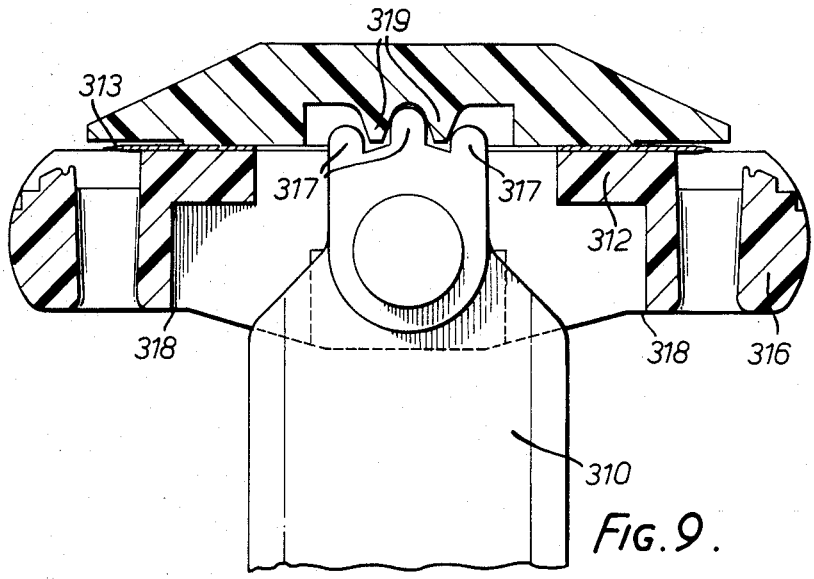
Figure 10:
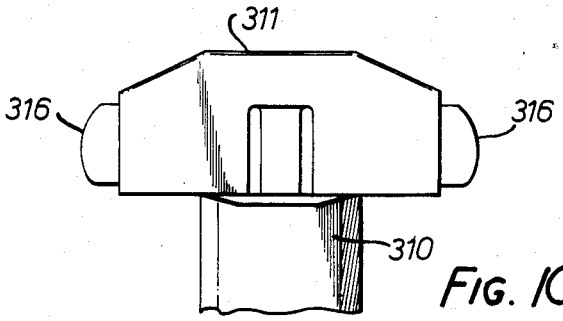
FIGS. 10, 11 and 12 are respectively an end elevation, a view from below, part sectioned, and a side elevation of the third form of razor.
Figure 11:
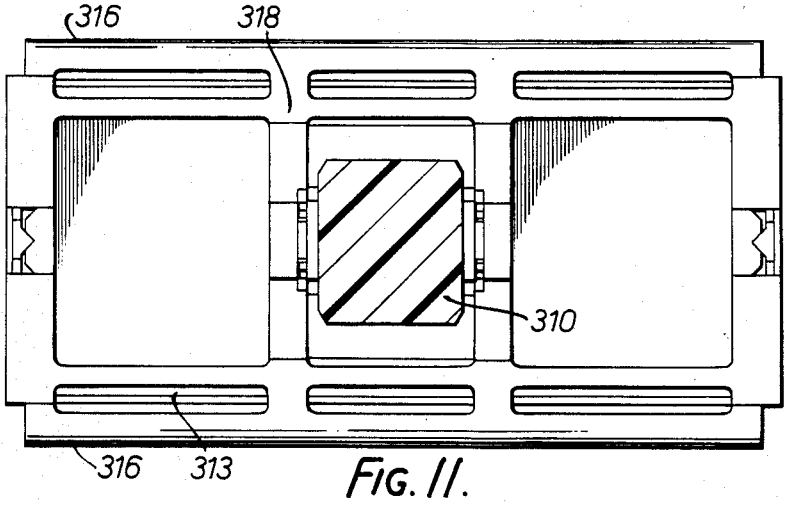
Figure 12:
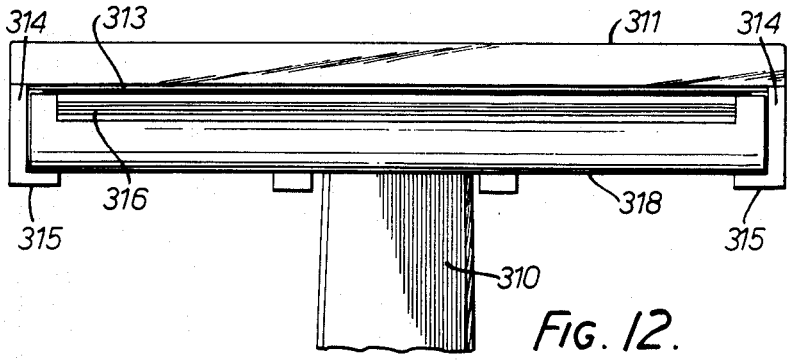

It will be apparent from FIG. 9 that in the position shown in which the handle 310 is perpendicular to the blade platform 312, the top cap 311 is disposed symmetrically with respect to the blade edges and covers each of these blade edges. This is the "safe" or "travel" position of the top cap.

Figure 8:
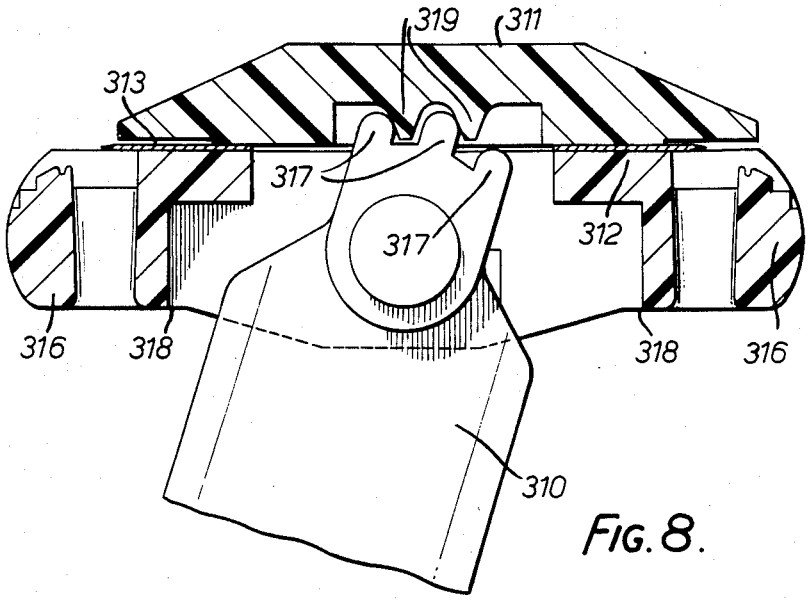
FIGS. 8 and 9 are cross-sections through a third form of razor in accordance with the invention, showing a double-edge razor of which a top cap is movable to expose one blade edge, to cover both edges or to expose the other blade edge.

If, however, the handle is swung clockwise through the position shown in FIG. 8, the inter-engagement of the pinion teeth with the rack teeth causes the top cap to move to the right as shown in FIG. 8 to uncover the left hand blade edge until it is sufficiently exposed for shaving. Conversely, the handle can be swung in the anticlockwise direction to cause the top cap to cover the left hand blade edge and expose the right hand blade edge for shaving. In the position in which the blade is fully exposed, an edge 318 on the platform will engage against the handle 310.

A suitable sprung detent (not shown) is provided on the top cap for engagement in any one of three recesses suitably placed on the blade platform for engagement with the sprung detent to locate the top cap relative to the blade platform in any selected one of the two "shaving" positions and the "safe" position of the blade.

Alternatively, means may be provided, such for example as a rack and screw mechanism by which the top cap can be moved progressively relative to the blade platform and stopped at any selected position to provide an infinite choice of blade exposure over a limited range.

Although the invention has been described in relation to disposable razors, the novel features of the invention reside primarily in the head of the razor and are therefore applicable to a shaving unit.

The expression 'pivotal movement' as used herein is intended to include all forms of rotational movement, whether about a fixed axis or a moving axis.

I claim

1. A razor blade assembly whose components comprise an elongate handle, a top cap rigidly secured to one end of the handle, a razor blade having a cutting edge and underlying the top cap, a guard bar disposed at the front of said assembly and spaced from the front edge of the top cap to form an opening therebetween, and means permanently supporting the blade beneath the top cap for solely pivotal movement relative thereto about an axis parallel to said cutting edge between a first position in which said cutting edge is exposed at said opening for shaving and said blade, top cap and guard bar cooperatively define the shaving geometry of the razor blade assembly, and a second position in which said cutting edge is retracted from said opening and underlies said cap in spaced relation thereto.

2. A razor blade assembly according to claim 1 wherein said guard bar is supported for pivotal movement together with said blade about said axis.

3. A razor blade assembly according to claim 1 wherein said blade is pivotally moveable relative to said guard bar.

4. A razor blade assembly according to claim 1 wherein said blade-supporting means includes a blade platform and said blade platform is pivotally moveable relative to said top cap about said axis, said blade being rigidly secured to said platform.

5. A razor blade assembly according to claim 4 including a base wall spaced from said top cap, and two spaced apart endwalls rigidly interconnecting the top cap and base wall to form a housing adapted to receive the blade and blade platform.

6. A razor blade assembly according to claim 1 having a blade platform to which the blade is rigidly secured and wherein the guard bar is rigid with the blade platform.

7. A razor blade assembly according to claim 1 wherein the guard bar is rigid with the top cap.

8. A razor blade assembly according to claim 1 wherein said components further comprise a razor handle rigid with said top cap.

* * * * *